United States Patent [19]

Robinson

[11] Patent Number: 4,490,003

[45] Date of Patent: Dec. 25, 1984

[54] ELECTRICAL CONNECTOR

[75] Inventor: Earl F. Robinson, Batavia, Ill.

[73] Assignee: C. R. Bard, Inc., Murray Hill, N.J.

[21] Appl. No.: 338,358

[22] Filed: Jan. 11, 1982

[51] Int. Cl.[3] ..... H01R 9/11

[52] U.S. Cl. ..... 339/75 MP; 339/91 R; 339/102 R; 339/176 MF

[58] Field of Search ..... 339/17 F, 176 MF, 75 MP, 339/91 R, 101, 102 R

[56] References Cited

U.S. PATENT DOCUMENTS

| | | | |
|---|---|---|---|
| 3,093,432 | 6/1963 | King | 339/101 |
| 3,140,907 | 7/1964 | Davies | 339/17 |
| 3,278,714 | 10/1966 | Bernutz | 339/91 R |
| 3,737,833 | 6/1973 | Jerominek | 339/91 R |
| 4,008,942 | 2/1977 | Grossi | 339/91 R |
| 4,243,034 | 1/1981 | Brandt | 128/214.4 |

FOREIGN PATENT DOCUMENTS

| | | | |
|---|---|---|---|
| 968866 | 6/1975 | Canada | 339/91 R |
| 1200409 | 9/1965 | Fed. Rep. of Germany | 339/91 R |
| 2801427 | 7/1978 | Fed. Rep. of Germany | 339/91 R |

*Primary Examiner*—John McQuade

*Attorney, Agent, or Firm*—Trexler, Bushnell & Wolters, Ltd.

[57] ABSTRACT

An electrical connector for a conductor that is printed on a dielectric strip, such as an electrode lead, comprises an insulating housing having a terminal therein and an opening into the housing for receiving the dielectric strip such that the printed conductor engages the terminal. Opposed jaws are pivotally supported in the housing on opposite sides of the terminal, the jaws being joined at corresponding ends by a resilient member to bias the jaws for releasable engaging notches in the dielectric strip. A novel strain relief member in which the resilient means is embedded may be used to prevent separation of the terminal from a connector lead wire.

9 Claims, 9 Drawing Figures

ELECTRICAL CONNECTOR

BACKGROUND OF THE INVENTION

This invention relates to electrical connectors, and more particularly to improvements in connectors for making electrically conductive contact with a printed electric circuit conductor on a thin flexible sheet of dielectric material.

The connector of the present invention is primarily intended for use with a skin contact electrode for measuring some physiologic function, such as electrocardiography or electroencephalography, or the like. These skin contact electrodes generally require individual connections between each of the electrodes and the equipment that measures physiologic function. Accordingly, it is desirable that the electrical connector for the electrode be of a rapid or "quick connect" type so as to reduce the time required to connect up all of the electrodes used for the monitoring or measuring function. Furthermore, it sometimes happens that a patient may be disconnected from the monitoring function for purposes of other medical procedures but with the electrode remaining with the patient. Therefore, the electrodes and the connectors should be capable of ready connection when the measuring or monitoring function is to be resumed. Additionally, the connector should be of the "low profile" type in that the connector should be relatively flat. This is of importance in situations where an electrode is on the back of the patient because under such conditions the patient must lie on the electrode frequently both during surgery and after recovery. Comfort thus becomes a significant factor which should be considered by the medical personnel.

OBJECTS AND SUMMARY OF THE INVENTION

An object of this invention is to provide an electrical connector which can be readily connected to or removed from the terminal portion of an electrode wherein such terminal portion is an electrical conductor printed upon a sheet of relatively thin dielectric material.

A further object of this invention is to provide a low-profile type of connector which readily grips the printed circuit conductor constituting the lead to the electrode.

Still another object of this invention is to provide a connector of the type stated which embodies a novel strain relief construction for preventing separation of the connector lead wire from the terminal within the connector.

In accordance with the foregoing objects the connector comprises an electrically insulated housing having a cavity and an opening providing communication from the cavity to the exterior of the housing, an electrical terminal within said housing and being presented towards said opening for receiving and contacting an electrical conductor projecting through said opening, and means for releasably retaining said conductor in said housing and in contacting relationship with said terminal; said means comprising at least one jaw member pivotally mounted on said housing and movable from a conductor-retaining position to a conductor-release position at which the conductor can be inserted into or withdrawn from the housing through said opening to make or break contact with said terminal, and resilient means biasing said jaw to said conductor-retaining position.

In the form of the invention disclosed there is a pair of jaws pivotally mounted on opposite sides respectively of the terminal, said jaws being joined by the resilient means such that the jaws and the resilient means constitutes a structure having both jaws biased toward their conductor-retaining positions. The resilient means may be plastic integrallymolded with the jaws or the resilient means may be a metal spring wire that joins the jaws. The spring wire may be molded within a strain relief member that forms part of the aforesaid novel strain relief construction.

DETAILED DESCRIPTION

Figure 3:
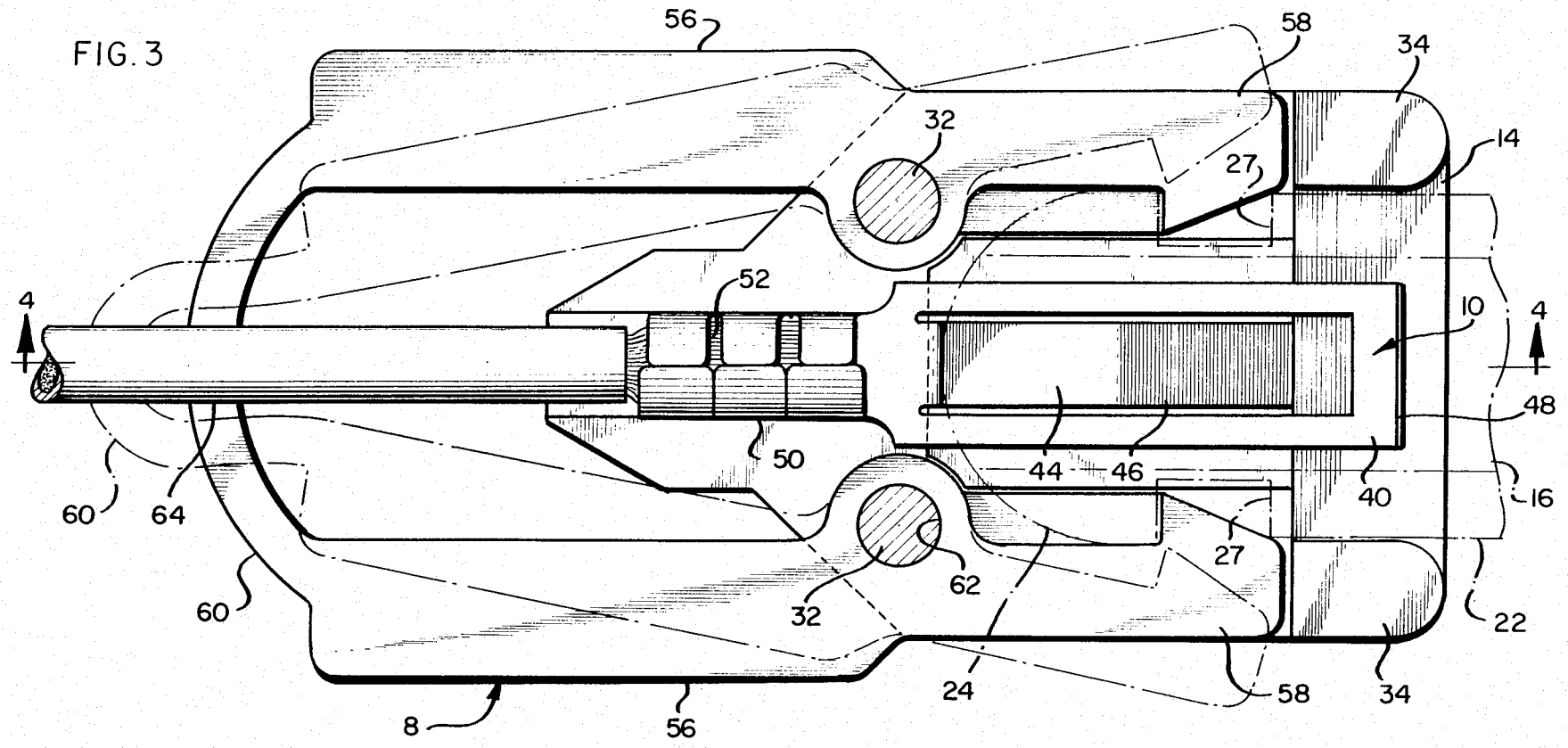
FIG. 3 is an enlarged top plan view of the connector partially broken away by removal of the top section and partially in section.
Figure 4:
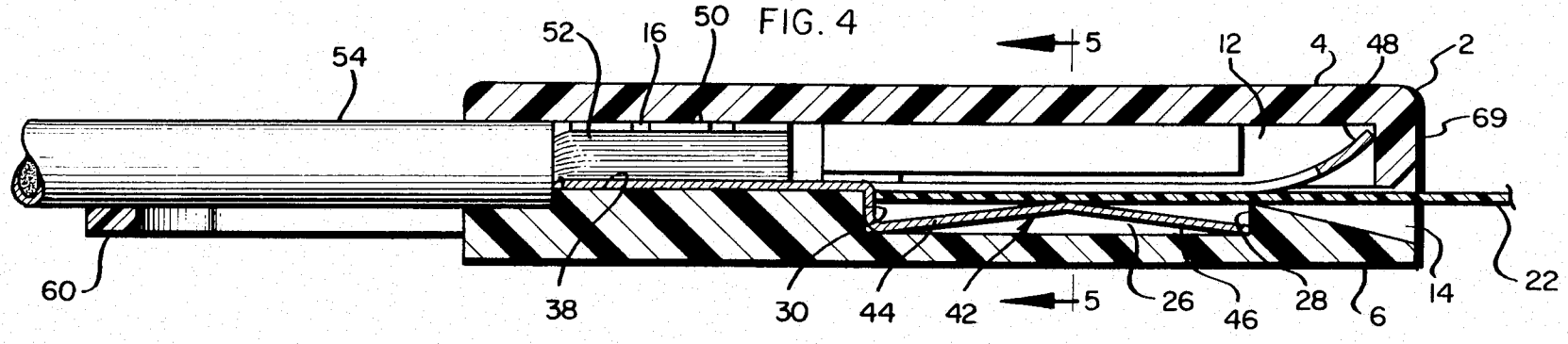
FIG. 4 is a sectional view taken approximately along line 4—4 of FIG. 3.

Referring now in more detail to the drawing, which illustrates a preferred embodiment of the invention, there is shown a housing 2 of a suitable plastic, for example, polycarbonate. The housing 2 comprises a top section 4 and an opposed bottom section 6 which cooperate to receive a jaw assembly 8 and an electrical terminal 10, all of which will presently be more fully described. The housing 2 is formed with a cavity 12 having front opening 14 and a rear opening 16 each for providing communication from the cavity 12 to the exterior of the housing. The electrical terminal 10 is within the cavity 12 and is presented toward the front opening 14 for receiving an electrical conductor in the form of a printed circuit lead 16 which in turn forms a printed circuit connection with electrode 18. Electrode 18 and the lead 16 are imprinted on a thin sheet of plastic 20 which may be a resin of the type sold under the trademark Mylar. The sheet 20 has a terminal strip 22 having a rounded forward end 24 (FIG. 3) adjacent to which are notches 27, 27 on opposite sides of the strip 22. Attached to the sheet 20 except at the lead 22 is a conventional foam elastomer pad 29.

The bottom housing section 6 includes a terminal well 26 forming part of the cavity 12. The terminal well has front and rear shoulders 28, 30 for receiving and retaining the terminal 10. The bottom 6 furthermore includes pivot posts 32, 32; front end plateaus 34, 34;

and ribs 36, 36 at the side boundaries of the terminal well 26. Also formed on the section 6 is a rear wall 38 the forward vertical edge of which defines a shoulder 30.

The sheet metal terminal 10 includes a body portion 40 of generally rectangular configuration from which is struck a tongue 42 having angularly related sections 44, 46 the forward section 46 of which engages the shoulder 28 and the rearward section 44 of which terminates in a flange that engages the shoulder 30. The body portion 40 has a forwardly extending lip 48 which diverges with respect to the tongue section 46 for receiving electrode terminal strip 22. The terminal 10 also has a tail 50 having a multiplicity of sections for crimping to a wire 52 with an insulation 54. The tail 50 rests on the wall 38 and with the insulated wire projecting outwardly from the rear opening 16.

The jaw assembly 8 comprises a one-piece plastic member having opposed jaws 56, 56 with gripper ends 58, 58 at one end thereof and with the arms of the jaws projecting outwardly from the housing and terminating in an arcuate resilient member 60. The jaws have holes 62, 62 for pivotal connection respectively with the pivot posts 32, 32 whereby the spring member 60 biases the jaws to the full line position shown in FIG. 3, namely to the jaw-closed or conductor retaining positions in which the gripper ends 58, 58 are in the notches 27, 27. The jaw arms may, however, be depressed in opposition to the force of the spring member 60 to move the gripper ends 58, 58 to the broken line position shown in FIG. 3 to permit insertion of the terminal strip 22 into or withdrawal of the terminal strip 22 from the connector. The spring member 60 has a notch 64 to provide clearance for the wire insulation 54.

The top section 4 comprises weldment lugs 66, 66 and a generally U-shaped wall or rib 68, the portion 69 of which provides a flange at the front opening 14 and an abutment for the terminal lip 48. The body of the section 4 also has shallow holes 70, 70 that receive the tops of the posts 32, 32. The sections 4, 6 are ultrasonically welded together along their interfaces at the plateaus 34, 34 and the weldment lugs 66, 66.

Use of the connector will be apparent from the foregoing description. With the gripper ends 58, 58 spread apart the terminal strip 22 is inserted into the opening 14 as far as it will go whereupon the jaws are released so that the jaw grippers 58, 58 engage in the notches 27, 27 to prevent retraction of the strip 22 from the connector. The printed circuit lead 16 will be retained in conductive engagement with the terminal 10. Disconnecting the printed circuit lead 16 is effective simply by opening the jaws and retracting the terminal strip portion 22.

Figure 1:
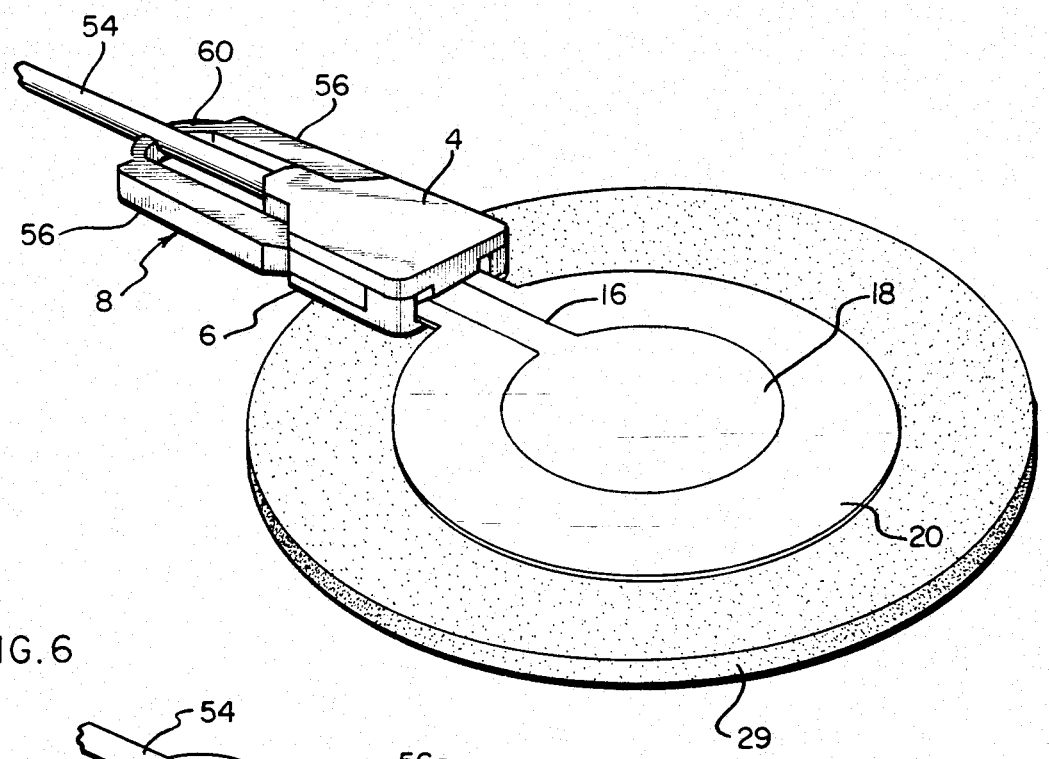
FIG. 1 is a perspective view of a connector of this invention shown electrically connected to the terminal portion of an electrode that comprises a printed circuit on a thin sheet of plastic material.
Figure 6:
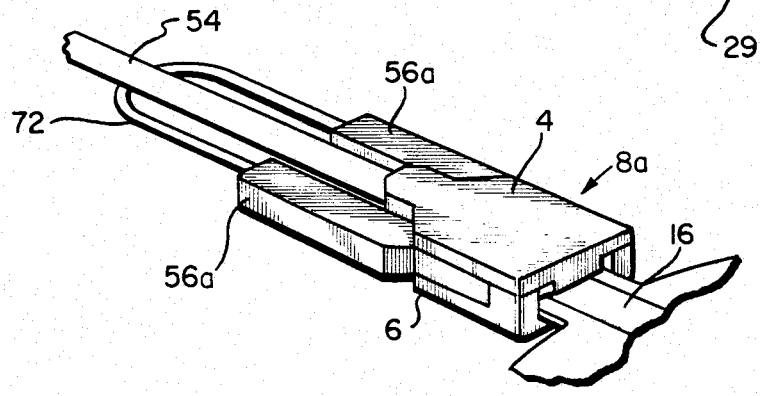
FIG. 6 is a perspective view of a modified form of the invention.
Figure 5:
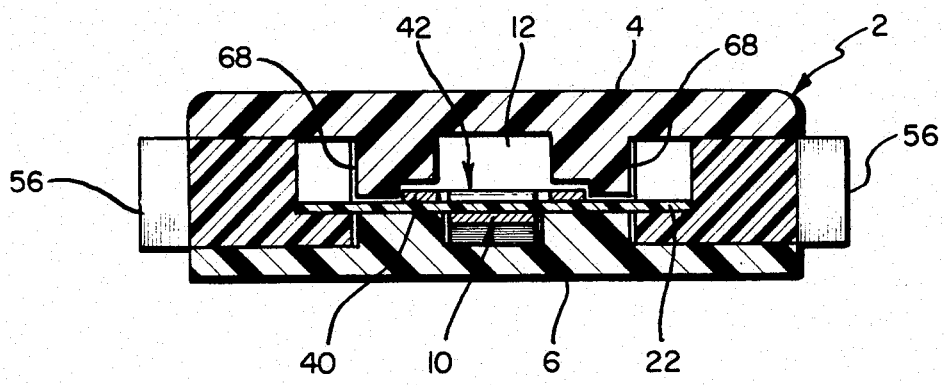
FIG. 5 is a fragmentary sectional view taken along line 5—5 of FIG. 4.
Figure 2:
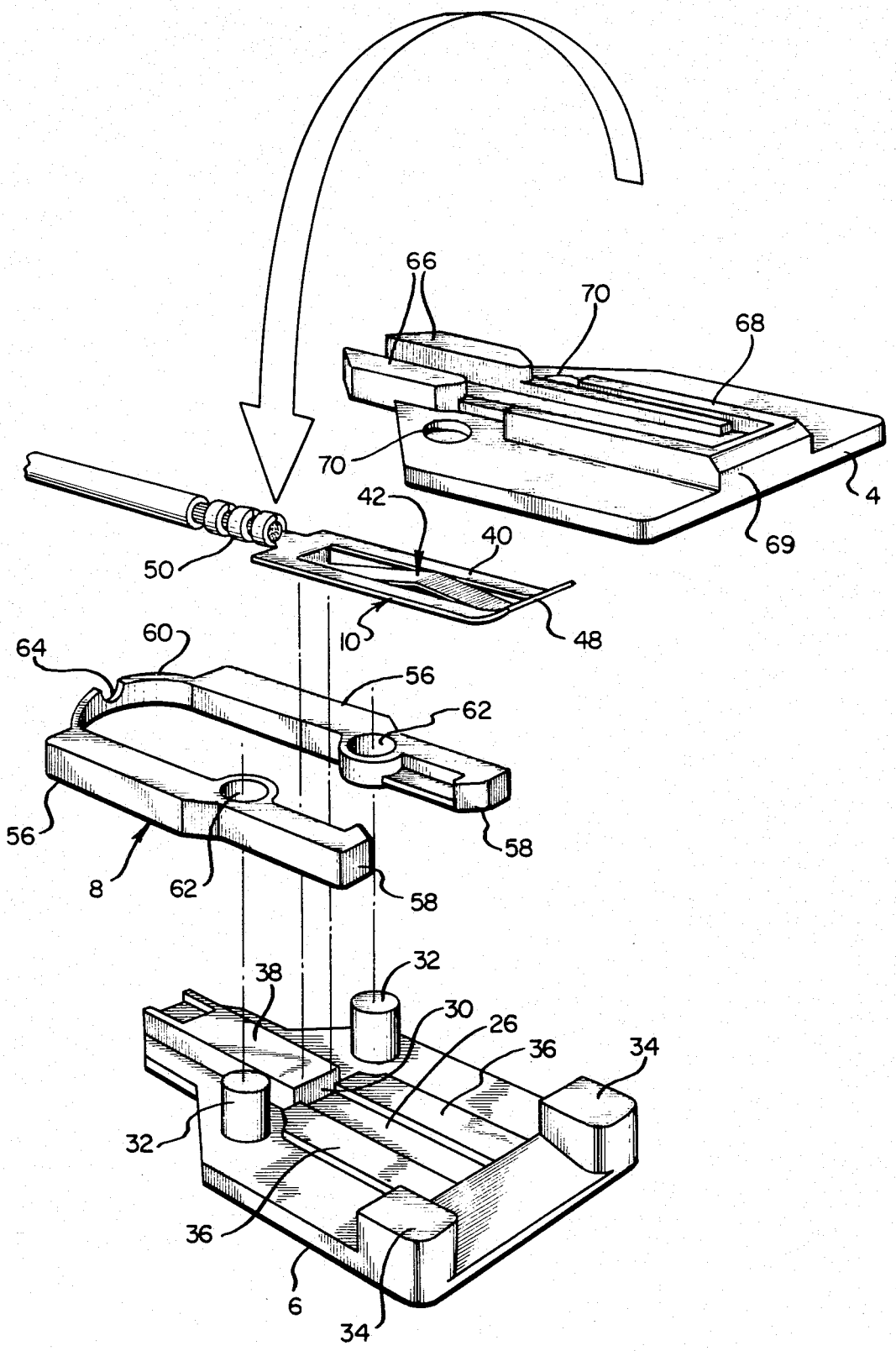
FIG. 2 is an exploded perspective view of the connector and showing the top section of the connector inverted (the large arrow showing inversion prior to assembly) for purposes of clarity of Illustration.

The form of the invention shown in FIG. 6 is similar to that shown in FIGS. 1–5 and the like reference numerals in FIG. 6 as compared to FIGS. 1–5 indicate like parts. However, the jaw assembly **8*a* comprises jaws 56, 56 projecting from the housing but with the plastic resilient member 60 of FIGS. 1–5 being replaced by a U-shaped wire spring 72 that is embedded at its opposite ends respectively in the jaws 56*a*, 56*a*. This spring 72** biases the jaws to the jaw-closed position.

Figure 7:
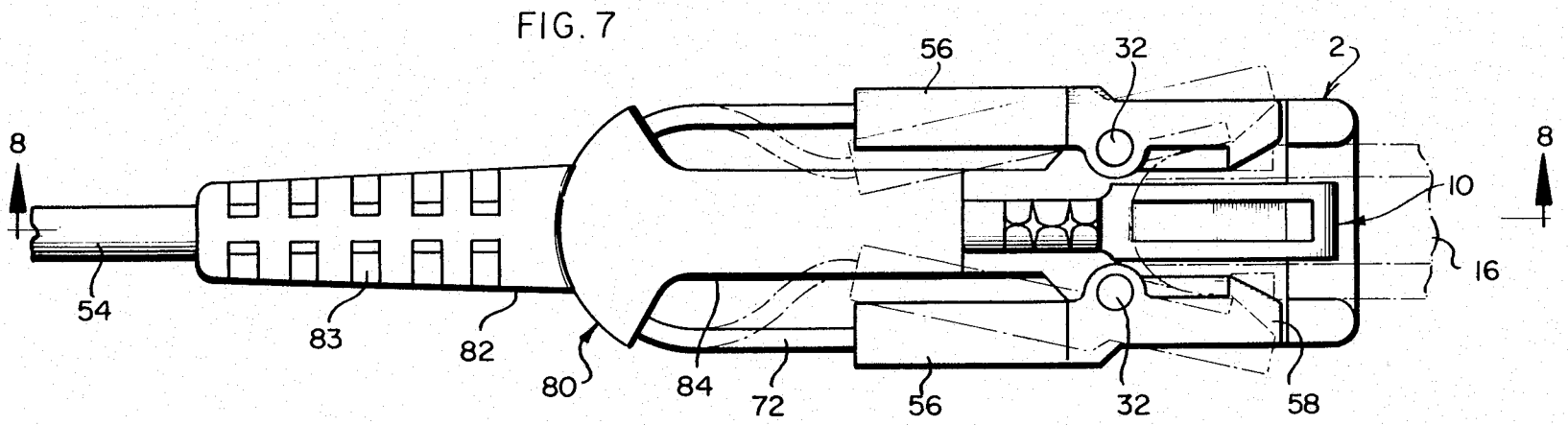
FIG. 7 is an enlarged plan view of the connector of FIG. 6 but embodying a strain relief member.
Figure 8:
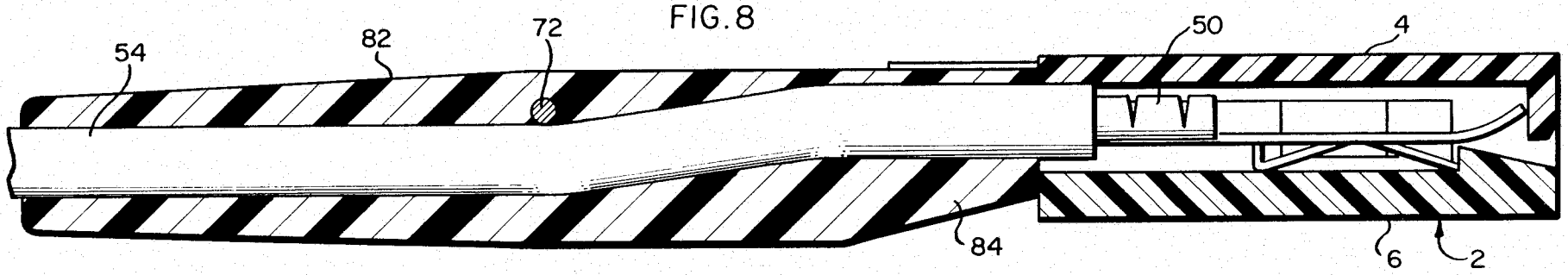
FIG. 8 is a sectional view taken along line 8—8 of FIG. 7.
Figure 9:
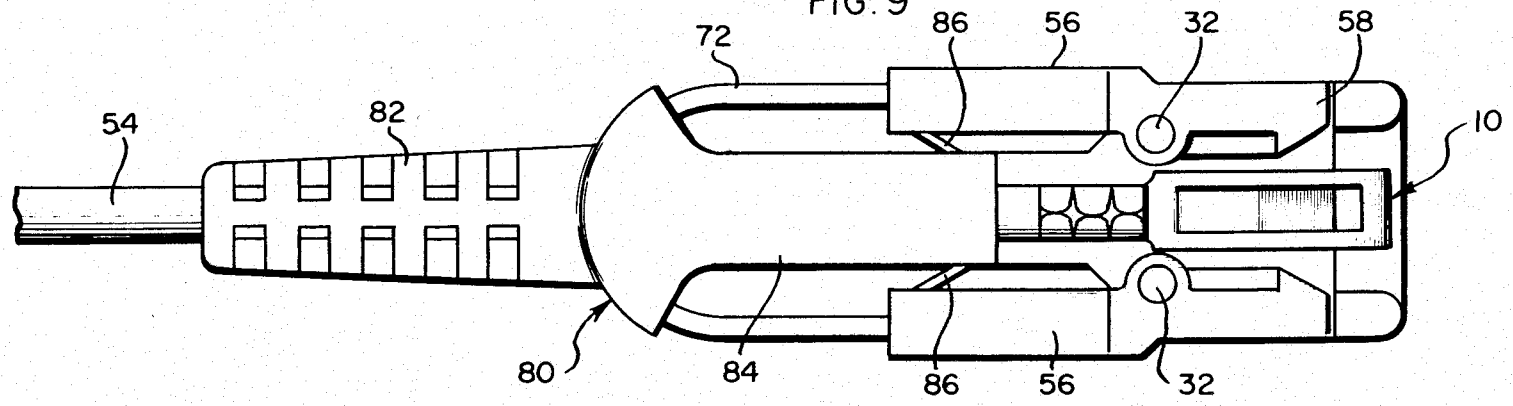
FIG. 9 is a top plan view of a further embodiment of the invention and which utilizes auxiliary springs for biasing the jaws closed.

The forms of the invention shown in FIGS. 7–9 are similar to the forms previously described and like reference numerals in FIGS. 1–6 as compared to FIGS. 7–9 indicate like parts. However, in FIGS. 7–9 a strain relief member 80 is utilized to resist separation of the lead wire 54 from the terminal 10. The strain relief member 80 serves to transmit forces from the lead wire 54 to the pivot posts 32 which are integral with the housing 2. The strain relief member 80 includes a rear section 82 which is tapered and is formed with notches 83 to enhance its flexibility. As best seen in FIGS. 7 and 8 the lead wire 54 is embedded in the strain relief member. The strain relief member 80 also includes a forward section 84 which abuts the housing 2. The bight portion of the U-shaped spring wire 72 is molded in the generally sector-shaped center portion of the strain relief member 80 so that forces on the strain relief member 80 will be transmitted through the wire spring 72 to the jaws 56 and to the pivot posts 32, 32. The strain relief function is therefore present regardless of whether or not the jaws are open (broken line position in FIG. 7) or are closed. Moreover the strain relief member 80 does not impair the flexing of the arms of the U-shaped spring 72.

In the form of the invention shown in FIG. 9 the strain relief arrangement is similar to that of FIGS. 7 and 8. However, in the connector of FIG. 9 relatively short flat springs 86, 86 are embedded in the respective jaws 56, 56 and abut the forward section 84 of the strain relief member 80. These springs 86, 86 work in conjunction with and thereby aid the wire spring 72 to bias the jaws closed.

The invention is claimed as follows:

1. An electrical connector comprising an electrically insulated housing having a cavity and an opening providing communication from the cavity to the exterior of the housing, an electrical terminal within said cavity and having a first end presented toward said opening for receiving and contacting an electrical conductor projecting through said opening, a lead wire electrically connected to the second end of said terminal and extending from said housing, and means for releasably retaining said conductor in said housing and in contacting relationship with said terminal; said means comprising at least one jaw member pivotally mounted on said housing and movable from a conductor-retaining position to a conductor-release position at which the conductor can be inserted into or withdrawn from the housing through said opening to make or break contact with said terminal, and resilient means biasing said jaw member to said conductor-retaining position, said resilient means comprising a U-shaped length of wire one end of which is affixed to said jaw member, and a strain relief member molded over said lead wire with a segment of the return bend portion of the U-shaped wire embedded in said strain relief member for transmittal of strain from the lead wire to said U-shaped wire providing said resilient means.

2. A connector according to claim 1 having a pair of jaws members pivotally mounted on opposite sides respectively of said terminal, said jaw members being joined by said resilient means such that the jaw members and resilient means constitute a structure with both jaw members being biased toward their conductor-retaining positions, said jaw members being of an electrically insulating material.

3. A connector according to claim 2 in which said terminal has sections diverging toward said opening and shaped to receive a sheet of material having said conductor printed thereon, said sheet having notches for receiving the jaw members.

4. A connector according to claim 1 including auxiliary spring means disposed between said jaw member and said strain relief member and operable in aid of said resilient means.

5. An electrical connector comprising an electrically insulated housing having a cavity and an opening providing communication from the cavity to the exterior of the housing, an electrical terminal within said cavity and having a first end presented toward said opening for receiving and contacting an electrical conductor projecting through said opening, and means for releasably retaining said conductor in said housing and in contacting relationship with said terminal; said means comprising a pair of jaw members pivotally mounted on opposite sides of said housing and movable from a conductor-retaining position to a conductor-release position at which the conductor can be inserted into or withdrawn from the housing through said opening to make or break contact with said terminal, each said jaw member being pivotally mounted intermediate the respective ends thereof to define a gripper portion and an arm portion, said arm portion of each jaw member being depressible to move the jaw member from the conductor-retaining position to the conductor-release position, and resilient means biasing said jaw members to said conductor-retaining position, said resilient means being joined to the arm portion of each jaw member, such that the resilient means and the jaw member define an integral structure, with said resilient means biasing said arm portions outwardly of the housing and correspondingly urging said gripper portions inwardly of the housing to the conductor retaining position, and wherein said resilient means is in the form of a U-shaped link of spring wire having the ends thereof embedded in the gripper portions of the respective jaw members.

6. An electrical connector according to claim 5 wherein said electrical terminal has sections diverging toward said opening and shaped to receive a sheet of dielectric material having said conductor printed thereon, said sheet having notches for receiving the ends of the gripper portion of the jaw members.

7. An electrical connector comprising an electrically insulated housing having a cavity and an opening providing communication from the cavity to the exterior of the housing, an electrical terminal within said cavity and having a first end presented toward said opening for receiving and contacting an electrical conductor projecting through said opening, and means for releasably retaining said conductor in said housing and in contacting relationship with said terminal; said means comprising a pair of jaw members pivotally mounted on opposite sides of said housing and movable from a conductor-retaining position to a conductor-release position at which the conductor can be inserted into or withdrawn from the housing through said opening to make or break contact with said terminal, each said jaw member being pivotally mounted intermediate the respective ends thereof to define a gripper portion and an arm portion, said arm portion of each jaw member being depressible to move the jaw member from the conductor-retaining position to the conductor-release position, and resilient means biasing said jaw members to said conductor-retaining position, said resilient means being joined to the arm portion of each jaw member, such that the resilient means and the jaw member define an integral structure, with said resilient means biasing said arm portions outwardly of the housing and correspondingly urging said gripper portions inwardly of the housing to the conductor retaining position, and further including a lead wire connected to said electrical terminal, and a strain relief member abutting said housing for resisting separation of the lead wire from said electrical terminal, and said resilient means being embedded in said strain relief member.

8. An electrical connector according to claim 7 wherein said housing is of a two-piece construction, and defines a pair of opposed post members upon which said jaw members are pivotally mounted.

9. An electrical connector according to claim 7 including auxiliary spring means disposed in association with each said jaw member and operable in aid of said resilient means.

* * * * *